US005108196A

United States Patent [19]

Hughes

[11] Patent Number: 5,108,196

[45] Date of Patent: Apr. 28, 1992

[54] RELATING TO BULK CONTAINERS

[75] Inventor: James Francis J. Hughes, York, England

[73] Assignee: Bowater Packaging Limited, London, England

[21] Appl. No.: 762,794

[22] Filed: Sep. 19, 1991

Related U.S. Application Data

[63] Continuation of Ser. No. 629,279, Dec. 17, 1990, abandoned.

[30] Foreign Application Priority Data

Dec. 20, 1989 [GB] United Kingdom ..... 8928700

[51] Int. Cl.[5] ..... B65D 33/06; B65D 33/14

[52] U.S. Cl. ..... 383/17; 383/20; 383/117

[58] Field of Search ..... 383/17, 18, 20, 117; 222/105

[56] References Cited

U.S. PATENT DOCUMENTS

| | | | |
|---|---|---|---|
| 4,010,784 | 3/1977 | Nattrass et al. | 383/17 |
| 4,207,937 | 6/1980 | Sandeman et al. | 383/17 |
| 4,521,911 | 6/1985 | Vance . | |
| 4,524,457 | 6/1985 | Marino | 383/17 |
| 4,646,357 | 2/1987 | Nattrass . | |
| 4,781,473 | 11/1988 | Lafleur | 383/17 |
| 4,807,299 | 2/1989 | Nattrass et al. | 383/20 |
| 4,822,179 | 4/1989 | Nattrass | 383/17 |
| 4,913,321 | 4/1990 | Abboud | 222/105 |

FOREIGN PATENT DOCUMENTS

| | | | |
|---|---|---|---|
| 265063 | 4/1988 | European Pat. Off. | 383/17 |
| 0340622 | 4/1989 | European Pat. Off. . | |
| 1549448 | 8/1979 | Fed. Rep. of Germany . | |
| 7809415 | 8/1979 | Netherlands | 383/17 |
| 1602726 | 11/1981 | United Kingdom | 383/17 |
| 2130172 | 5/1984 | United Kingdom . | |

*Primary Examiner*—Gary E. Elkins
*Attorney, Agent, or Firm*—Darby & Darby

[57] ABSTRACT

A flexible bulk container comprises a side wall structure (1), a base (3) closing a lower open end of the side wall structure and a plurality of lifting loops (5 to 8) at the upper end of the side wall structure. The fabric of the side wall structure is folded to form a multi-layer band (4) extending circumferentially around at least the upper part of the side wall structure. Each lifting loop comprises a bight and two spaced legs, each leg being stitched to the multi-layer band by stitching comprising at least two substantially parallel rows (12, 13) of chain stitching extending circumferentially around the upper part of the side wall structure. The needle yarn used for the stitching is of not less than 4000 denier.

10 Claims, 2 Drawing Sheets

RELATING TO BULK CONTAINERS

This is a continuation of application Ser. No. 629,279, filed Dec. 17, 1990, ABN.

This invention relates to flexible bulk containers such as are used in the storage and transport of materials in granular, powder and other particulate forms.

Such containers are generally in the form of large bags or sacks which are often required to carry loads of up to one tonne or more with considerable safety margin above this working load. The containers are commonly made from woven fabric, particularly woven polypropylene or other suitable synthetic material.

There have in the past been many proposals for the manufacture of such containers, and also many proposals for providing the containers with lifting loops at the upper part of the container. In the most commonly used construction the lifting loops are loops of high strength webbing which are stitched to the side walls of the container, desirably so that there is reinforcement in the area where stitching occurs. For example, the side wall fabric may be folded along fold lines extending from the top towards the bottom of the side wall so that each loop is stitched to a plurality of thicknesses of material. In another known arrangement each loop may be stitched to the side wall in a region where the side wall fabric itself is reinforced. In either case the stitching is made sufficiently dense so as to ensure a firm connection between the lifting loops and the fabric of the side wall over a reasonably wide area.

The points of attachment of the lifting loops to the side walls are generally regions of high stress concentration, and despite reinforcement the areas surrounding these connections are the commonest failure areas for these containers. This is particularly the case where the container is mishandled, for example lifted or pulled with only a single loop of the container engaged by the lifting or pulling means. The object of the invention is to provide a container with improved stress distribution into the side wall structure, and to simplify the manufacture and reduce the cost of such containers.

According to the present invention a flexible bulk container comprises a side wall structure of flexible woven fabric, a base closing a lower open end of the side wall structure and a plurality of lifting loops at the upper end of the side wall structure, each loop having a bight and two spaced legs, each leg being stitched to the side wall structure; characterised in that a multi-layer band extends circumferentially around at least the upper part of the side wall structure, and each leg is stitched to the multi-layer band by stitching comprising at least two substantially parallel rows of chain stitching extending circumferentially around the upper part of the side wall structure, the stitching thread being of not less than 4000 denier.

It has been found that a structure according to the invention provides a remarkably strong container having advantages in use and manufacture. Stress transference from the lifting loops into the fabric of the side wall structure is extremely good, and the connection between the loops and fabric is surprisingly strong in view of the small amount of stitching between the two. This stitching is very significantly less than the stiching used in the conventional technique of a dense lock stitch arrangement for securing the loops to the fabric. The avoidance of any fold lines in the side wall structure extending from the top towards the bottom of the side wall ensures that the whole open top of the bag is available for access, and improves both the handling characteristics and the appearance of the finished container. Use of chain stitching extending circumferentially around the upper part of the side wall structure allows the container to be manufactured easily and rapidly.

Preferably the multi-layer band is formed by folding the fabric of the side wall structure, although it could alternatively be formed by stitching one or more circumferentially extending plies of fabric around the appropriate part of the side wall structure.

Desirably the woven fabric comprises a base fabric and reinforcing bands woven integrally into the base fabric, each reinforcing band extending from the upper end to the lower end of the side wall structure, and each leg of each lifting loop being stitched to the multi-layer band in the region of a reinforcing band.

In one preferred embodiment the multi-layer band and each leg of each lifting loop extend partially down the side wall structure by a substantially equal distance. This is a very effective relationship both from a strength and a materials usage standpoint.

The multi-layer band desirably comprises three layers of side wall fabric formed by folding the fabric into a substantially S-shaped formation around the upper part of the side wall structure. It will usually be unnecessary to use more than three layers. A two layer band may be used in containers designed for lighter loads, for example loads of up to 0.5 tonne.

When a three layer band is used then each leg of each lifting loop may conveniently be received between two adjacent layers of the folded fabric. Again, this improves the appearance of the bag, and it also has advantages during the manufacture of the container.

In another preferred embodiment the fabric of the side wall structure is folded at the lower part of the side wall structure so that the whole of the structure is formed as a double-layer band. Effectively, a container with a double-skin wall is formed, giving additional strength and also allowing advantageous arrangements for closing the top of the container.

Preferably the side wall structure is a continuous tube formed from circular woven fabric. Use of circular woven fabric further improves stress distribution into the side wall structure. However, it is possible to apply the invention to containers wherein the side wall structure is made from panels of flat woven fabric, suitably stitched together.

The number of rows of chain stitching will be chosen according to the required strength. For containers rated up to 0.5 tonne load then two rows may be sufficient. For containers rated up to 1 tonne and designed for single trip use then four rows of stitching will be preferred. For multiple trip containers rated up to 1 tonne six rows of stitching may be desirable. In one particularly preferred arrangement the stitching may comprise a first pair of parallel rows of stitching formed by a twin needle machine and a second pair of parallel rows of stitching also formed by a twin needle machine, the two pairs of rows being spaced one above the other. Obviously, additional pairs of two parallel rows may be used as necessary. The stitching is desirably continuous from one pair of rows to the other in order to expedite manufacture and to gain maximum strength advantages.

The denier of the thread used for the stitching will again generally depend on the rated load of the container and may also depend on the numbers of rows of stitching used. A smaller number of rows may demand a heavier thread while a larger number of rows may make possible the utilisation of a lighter thread. The minimum weight for the needle yarn is 4000 denier, but a minimum of 5000 denier is more preferred. Needle yarn of 6000 denier has given excellent results, and the desired range may be from 5000 to 6000 denier. The thread used for the looper yarn may be lighter in weight than the needle yarn, and may for example be from 2000–4000 denier, more preferably from 3000–4000 denier.

The upper end of the container may be open or, more preferably, may be closed by a top either stitched to the upper end of the side wall structure (either by the same stitching used for connection of the lifting loops, or in a separate stitching operation after the loops have been attached) or continuous with the upper end of the side wall structure. The top may be formed with any suitable opening and/or skirt arrangement, and the bottom may be formed of any suitable discharge arrangement. If required, the container may be formed with an inner, impervious liner within which the load is contained, to give added protection against the ingress of moisture and also to prevent fine material escaping from the container. Similar protection may be given by a suitable coating applied to the fabric of the side wall structure.

In order that the invention may be better understood, specific embodiments thereof will now be described in more detail, by way of example only, with reference to the accompanying drawings in which.

Figure 1:
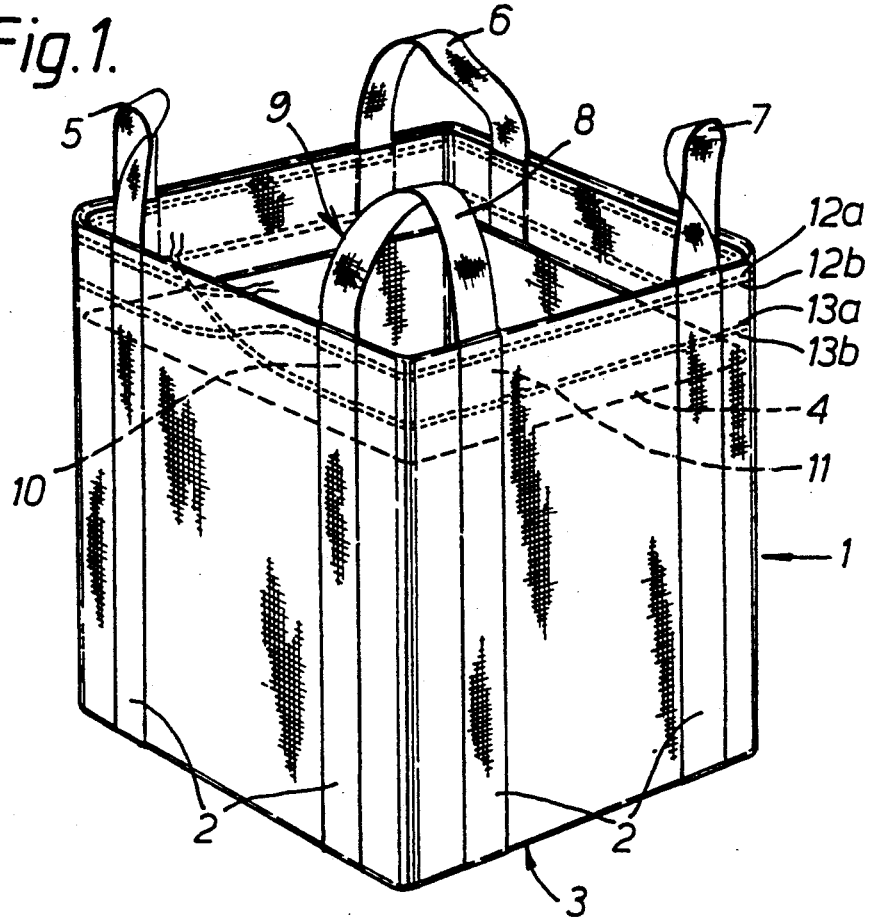
FIG. 1 is a perspective view of a first embodiment of container according to the invention.

FIG. 1 shows a flexible bulk container having a side wall structure 1 that is formed from a length of circular woven fabric, with warp threads extending longitudinally of the wall structure and weft threads extending cicumferentially of the wall stucture. The fabric comprises a base fabric having reinforcing bands 2 woven integrally into the base fabric and each extending from the upper to the lower end of the side wall structure. The fabric is desirably plain woven, preferably using polypropylene wrap tapes of about 3 mm in width. Weft tape widths can vary to give strength and appearance as required. It will be understood, however, that other weave patterns such as twill, basket and rib weaves may be used, and it will also be understood that materials other than polypropylene may be used.

Formation of woven fabric having the required integral reinforcing bands can readily be achieved by conventional weaving techniques. The reinforcing bands may be provided by, for example, cramming of warp threads in the region of the reinforcing band, ie making the number of warps per cm in the reinforcing band regions greater than the number of warps per cm in the base fabric. Alternatively the reinforcing bands may incorporate warp yarns of higher tensile strength that the warp yarns of the base fabric, either replacing entirely the warp yarns used for the base fabric or being used in addition to those warp yarns. When higher strength yarns are used they may be made from any suitable natural fibre or from either synthetic or semi-synthetic polymer, such as polyester, polyamide, polyolefin or polyacrylic. Alternatively, higher strength warp theads may also be of polypropylene, possibly of a higher count than the threads of the base fabric or of a thread similar to the base thread that has been treated, eg by fibrillation, in order to increase its tensile strength. The aforementioned suggestions for forming reinforcing bands do not constitute an exhaustive list, and other approaches can be used.

Figure 3:
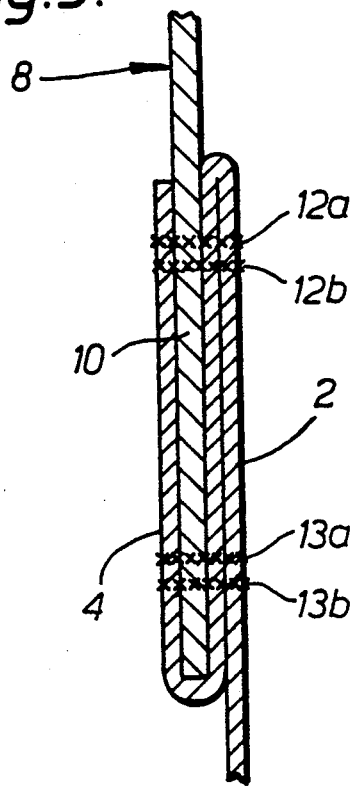
FIG. 3 is a section on the line III—III of FIG. 2.

The lower open end of the side wall structure is closed by a base 3. At the upper end of the side wall structure there is formed a multi-layer band 4 extending circumferentially around the side wall structure. As seen in FIG. 3 the band comprises three layers of the circular woven fabric, formed by folding that fabric into a sustantially S-shaped formation.

The container has four lifting loops 5 to 8, all of which are similar, and all of which are connected to the container in similar manner. For example, loop 8 comprises a bight 9, extending over a corner of the container and two spaced legs 10, 11 each secured to the fabric of the side wall structure in the region of a reinforcing band 2 by a stitched connection. Each loop is twisted so as to improve stress distribution. Each leg has a width substantially equal to the width of the reinforcing band to which it is stitched, and extends down the side wall structure for a distance substantially equal to the depth of the band 4, the end of the leg being received between two adjacent layers of the folded fabric of the band.

The stitched connection is effected by a first pair of parallel rows 12*a*, 12*b* of stitching and a second pair of parallel rows 13*a*, 13*b* of stitching, the two pairs of rows being spaced one above the other. Each pair of rows is formed by a twin needle machine and the stitching is continuous from one pair of rows to the other, as will be seen from FIG. 2. The stitching is simple chain-stitching, using a thread for the neddle yarn of not less than 4000 denier, more preferably 5000 denier, and usually of about 6000 denier. Polypropylene thread of 6000 denier has been found particularly suitable, although other materials can be used. The thread for the looper yarn may be of 2000 to 4000 denier, more preferably from 3000 to 4000 denier, and a nylon thread of 3600 denier has been formed particularly suitable.

Figure 2:
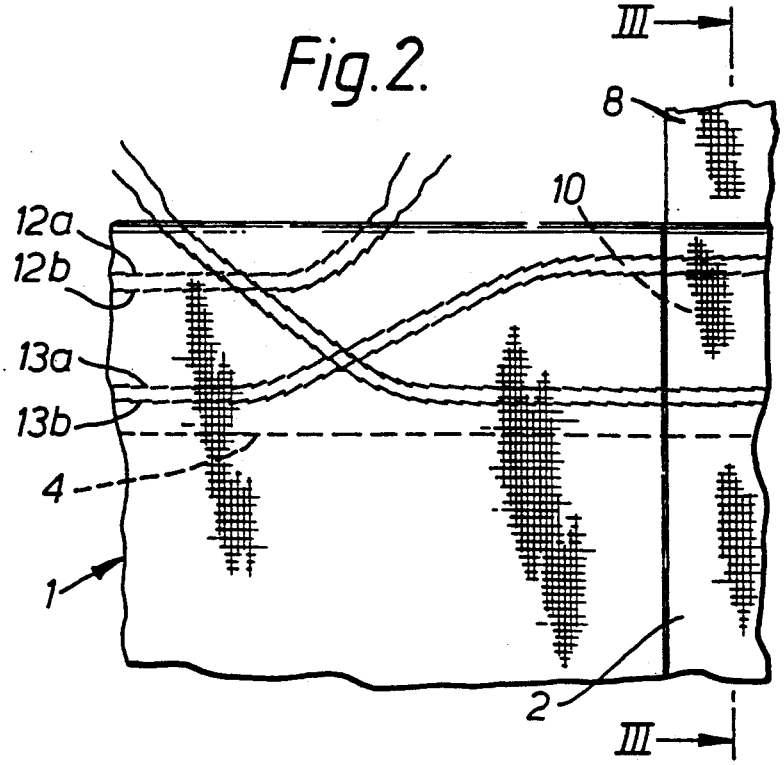
FIG. 2 is an enlarged view of part of the container of FIG. 1.

It will be seen from FIG. 2 that the stitching can be effected by a simple run in of the chain-stitch to the folded band at the upper part of the side wall, and a simple run out of the chain-stitch when both pairs of parallel rows have been completed.

In a particular example of a container according to the invention the side wall structure is formed from plain woven polypropylene fabric, having reinforcing bands formed by a double density of warp threads, all warps and wefts of the fabric being of the same polypropylene tape of about 3 mm in width. The average weight of the fabric is about 195 g/m$^2$, which will be recognised by those skilled in the art as being a particularly light-weight fabric. The upper edge of the side structure is folded into a three layer band as shown in FIG. 3, the depth of the band being about 10 cm. Lifting loops of about 100 mm in width are attached at each end to a reinforcing band having a width of about 90 to 95 mm. Stitching is effected by two pairs of parallel rows of stitching as shown in the drawings, using polypropylene needle yarn of 6000 denier and nylon looper yarn of 3600 denier. The container has a rated load of 1 tonne, but under test conditions it has been found capable of carrying a load of 5.5 to 6 tonnes. It also proved to be well capable of supporting a 1 tonne load on only a single loop, and of withstanding the shock force when two loops were slipped off the tines of a forklift truck with a 1 tonne load present in the container.

A container similar to that shown in FIG. 1, but with three pairs of parallel rows of stitching as aforesaid was found capable of supporting a load of 6.5 to 7 tonnes before failure.

Figure 4:
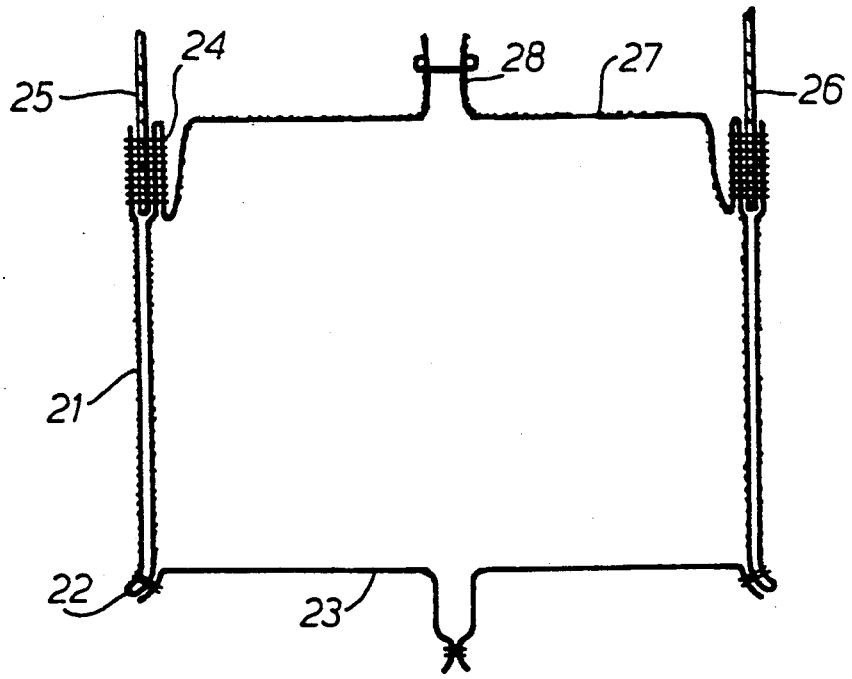
FIG. 4 is a schematic cross-section of a second embodiment of container according to the invention.

Referring to FIG. 4 this shows a container having a side wall structure 21 formed from a double thickness of circular woven fabric, the fabric having been folded back on itself along a fold line 22 at the lower end of the side wall structure. This avoids the necessity for hemming of the side wall fabric along the lower end of the container. A base 23 is stitched to the side wall structure in the region of the fold line. Effectively, the whole of the side wall structure is thus formed as a double-layer band. The fabric of the inner layer is folded over inwardly as shown at 24 at the top of the structure to form a three-layer thickness of fabric extending around the upper part of the side wall structure. The loop 25, 26 of lifting loop are received between the two outer layers of fabric, and are stitched to all three layers by stitching as already described.

FIG. 4 also shows the side wall fabric extended from the region of three-layer thickness over the top of the container to form a top skirt 27 gathered into a filling neck 28.

A container with a double-skin wall as shown in FIG. 4 is particulary good for heavier loads, eg of 1.5 tonnes and over, and for hazardous goods containers requiring U.N. certification. The top skirt is extremely strong as it is formed integrally with the side wall structure, and the container withstands very well the standard "topple test" for hazardous goods.

It will be understood that a container according to the invention may readily be made to carry a variety of different loads at different safety ratings. Specific dimensions and materials given in the foregoing decription are illustrative only. Thus, higher load capacity can be attained by increasing the depth of the multi-layer band, by increasing the width of the webbing from which the lifting loops are formed and of the reinforcing bands to which those loops are attached, by increasing the numbers of rows of stitching, by increasing the weight and strength of the thread used in those rows, and by increasing the average weight of the fabric used for the side wall structure. Lower rated containers will have a single skin wall and can generally use shallower multi-layer bands, narrower lifting loops, less rows of stitching and lighter thread. Indeed, in lower rated containers the reinforcing band may be a two-layer band rather than a three-layer band, although this may need to be deeper than in a three-layer band construction. Lower rated containers can also be made using lighter side wall fabric, significantly lighter than 195 $g/m^2$ may be used for a half tonne container.

As illustrated, the container of FIG. 1 is shown with a continuous base, and is open at the top. A top panel or structure may be stitched into such a container either in an operation simultaneous with the securing of the lifting loops to the side wall structure, or in a separate operation after the loops have been so secured. It will be understood that the base and top structures may take any desired form. The containers illustrated are provided with a square base, so dictating a generally square section for the container, and with four lifting loops one extending over each corner. However, other container cross-sections are equally feasible, and it is also possible to provide either less or more than four lifting loops.

I claim:

1. A flexible bulk container comprising:

a side wall structure of flexible circular woven fabric;

a base closing a lower open end of the side wall structure; and a plurality of lifting loops at the upper end of the side wall structure, each loop having a bight and two-spaced legs, each leg being affixed by stitching to the side wall structure;

wherein a multi-layer band formed by folding the top of the side wall extends circumferentially around at least the upper part of the side wall structure, and wherein each leg is stitched to the multi-layer band, and the layers of the multi-layer band are stitched together, by stitching that comprises at least two substantially parallel rows of chain stitching passing through all layers of the multi-layer band and extending circumferentially around the upper part of the side wall structure, the stitching thread being of not less than 4000 denier.

2. A flexible bulk container according to claim 1 wherein the woven fabric comprises a base fabric and reinforcing bands woven integrally into the base fabric, each reinforcing band extending from the upper end to the lower end of the side wall structure, and each leg of each lifting loop being stitched to the multi-layer band in the region of a reinforcing band.

3. A flexible bulk container according to claim 2 wherein each leg of each lifting loop has a width substantially equal to the width of the reinforcing band to which that leg is stitched.

4. A flexible bulk container according to claim 1 wherein the multi-layer band and each leg of each lifting loop extend down the side wall structure by a substantially equal distance.

5. A flexible bulk container according to claim 1 wherein the multi-layer band comprises three layers of side wall fabric formed by folding the fabric into a substantially S-shaped formation around the upper part of the side wall structure.

6. A flexible bulk container according to claim 5 wherein each leg of each lifting loop is received between two adjacent layers of the folded fabric.

7. A flexible bulk container according to claim 1 wherein the fabric of the side wall structure is folded at the lower part of the side wall structure so that the whole of that structure is formed as a double-layer band.

8. A flexible bulk container according to claim 1 wherein the stitching comprises a first pair of parallel rows of stitching formed by a twin needle machine and a second pair of parallel rows of stitching also formed a twin needle machine, the two pairs of rows being spaced one above the other.

9. A flexible bulk container according to claim 8 in which the stitching is continuous from one pair of rows to the other.

10. A flexible bulk container comprising:

a side wall structure of flexible circular woven fabric;

a base closing a lower open end of the side wall structure; and a plurality of lifting hoops at the upper end of the side wall structure, each such loop having a bight and two-spaced legs, each leg being affixed by stitching to the side wall structure;

the side wall structure having at least an upper circumferential multi-layer portion formed by folding the top of the side wall on itself, each leg being stitched to the upper circumferential multi-layer portion by stitching that comprises at least two substantially parallel rows of chain stitching extending circumferentially around the upper circumferential multi-layer portion and passing through all layers of the multi-layer portion to stitch all the layers together, the stitching thread being of not less than 4000 denier.

* * * * *